US012558600B2

(12) United States Patent
Miller

(10) Patent No.: US 12,558,600 B2
(45) Date of Patent: Feb. 24, 2026

(54) GAME SYSTEM FOR A PROJECTILE LAUNCHING GAME

(71) Applicant: Keith Miller, Chesterfield, MI (US)

(72) Inventor: Keith Miller, Chesterfield, MI (US)

( * ) Notice: Subject to any disclaimer, the term of this patent is extended or adjusted under 35 U.S.C. 154(b) by 477 days.

(21) Appl. No.: 18/211,556

(22) Filed: Jun. 19, 2023

(65) Prior Publication Data

US 2024/0416203 A1 Dec. 19, 2024

(51) Int. Cl.

| | |
|---|---|
| ***A63B 67/02*** | (2006.01) |
| ***A63B 63/08*** | (2006.01) |
| *A63B 67/06* | (2006.01) |

(52) U.S. Cl.

CPC ..... *A63B 67/02* (2013.01); *A63B 63/08* (2013.01); *A63B 67/06* (2013.01); *A63B 2210/50* (2013.01)

(58) Field of Classification Search

CPC ..... A63B 67/02; A63B 63/08; A63B 67/06; A63B 2210/50

USPC ..... 473/174

See application file for complete search history.

(56) References Cited

U.S. PATENT DOCUMENTS

| | | | | |
|---|---|---|---|---|
| 3,202,429 | A | 8/1965 | Richman | |
| 3,578,333 | A | 5/1971 | Skokie, III | |
| 3,584,877 | A | 6/1971 | Florian | |
| 4,203,604 | A | 5/1980 | La Grange | |
| 6,575,841 | B1 | 6/2003 | Erdoes | |
| 2002/0098896 | A1* | 7/2002 | Rieber | A63D 15/04 473/10 |
| 2012/0225742 | A1* | 9/2012 | Max | A63B 63/08 473/481 |
| 2017/0128805 | A1* | 5/2017 | Cohen | A63B 67/02 |

FOREIGN PATENT DOCUMENTS

| | | |
|---|---|---|
| WO | WO2004067112 | 8/2004 |

* cited by examiner

*Primary Examiner* — Michael G Lee

(57) ABSTRACT

A game system for playing a game in which players launch projectiles by throwing them or striking them with a club in attempt to land the projectiles in particular zones to score points includes a platform and a plurality of containers positioned on the platform. Each container has a hole extending downwardly into the container which has a size such that each projectile is receivable alternately into each of the containers through the associated hole.

19 Claims, 7 Drawing Sheets

GAME SYSTEM FOR A PROJECTILE LAUNCHING GAME

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to game systems and more particularly pertains to a new game system for playing a game in which players launch projectiles by throwing them or striking them with a club in attempt to land the projectiles in particular zones to score points.

(2) Description of Related Art Including Information Disclosed Under 37 CFR 1.97 and 1.98

The prior art discloses myriad game systems which provide projectiles for launching into scoring areas. Many of these game systems include a golf club that is used to strike the projectiles onto a platform, and some of these comprise golf putt practice apparatuses. However, the prior art does not describe a game system which provides projectiles, a platform, and a plurality of containers positioned on the platform, where the projectiles are receivable in holes positioned at the top of and extending into the plurality of containers.

BRIEF SUMMARY OF THE INVENTION

An embodiment of the disclosure meets the needs presented above by generally comprising a platform with a front end and a rear end. The platform has a playing surface extending between said front end and said rear end which faces upwardly when the platform is positioned in a use configuration. A plurality of containers is positionable on the playing surface of the platform in a playing configuration when the platform is positioned in the use configuration. Each container comprises a perimeter wall and a top wall.

The perimeter wall is positionable on the playing surface and bounds an interior space. The top wall is coupled to a top edge of the perimeter wall and has a hole extending through the wall to the interior space. A plurality of projectiles are provided, each of which has a size such that each projectile of the plurality of projectiles is alternately receivable into each container of the plurality of containers through the hole of the top wall thereof.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
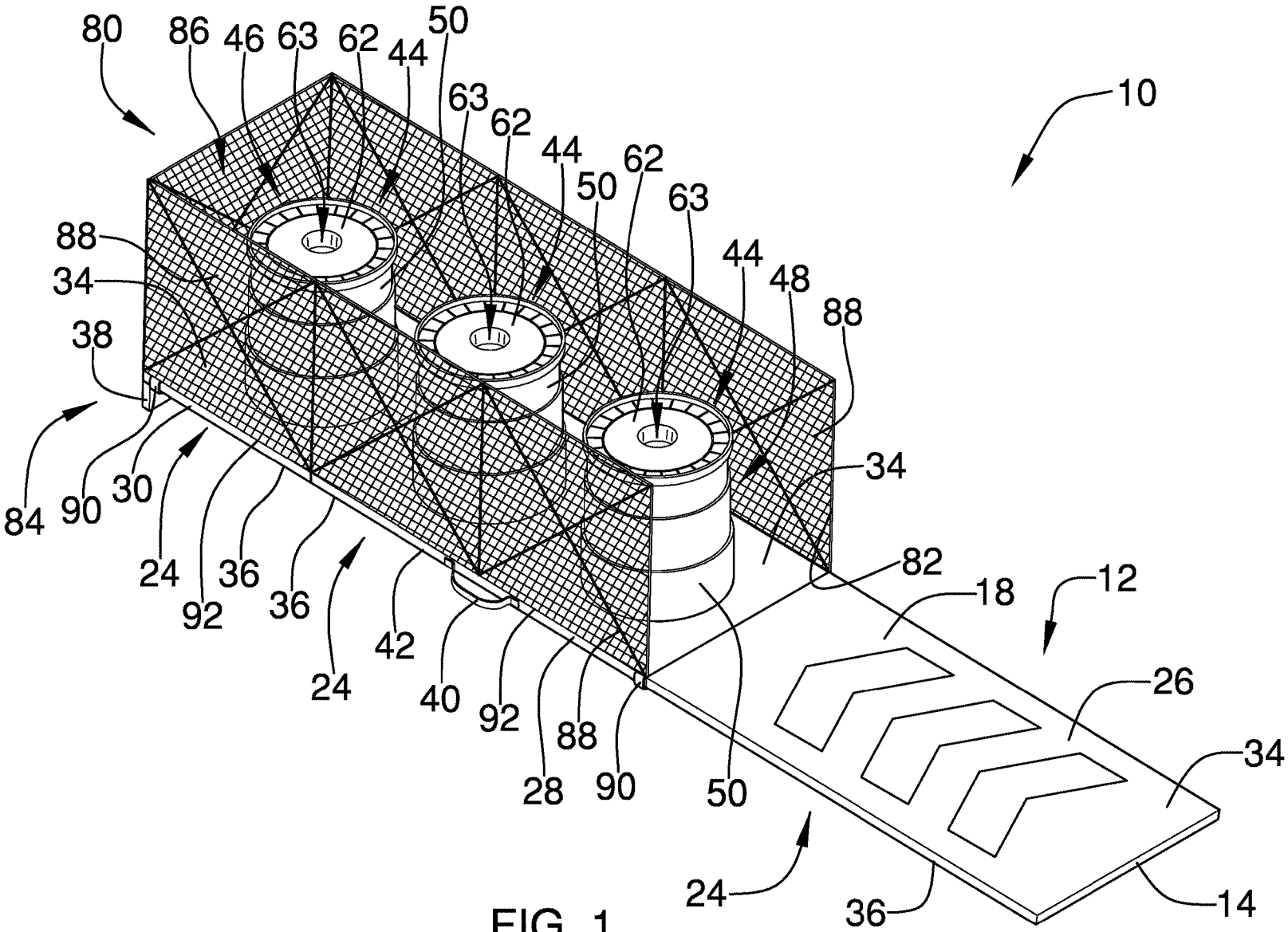
FIG. 1 is a top front side perspective view of a game system according to an embodiment of the disclosure.
Figure 2:
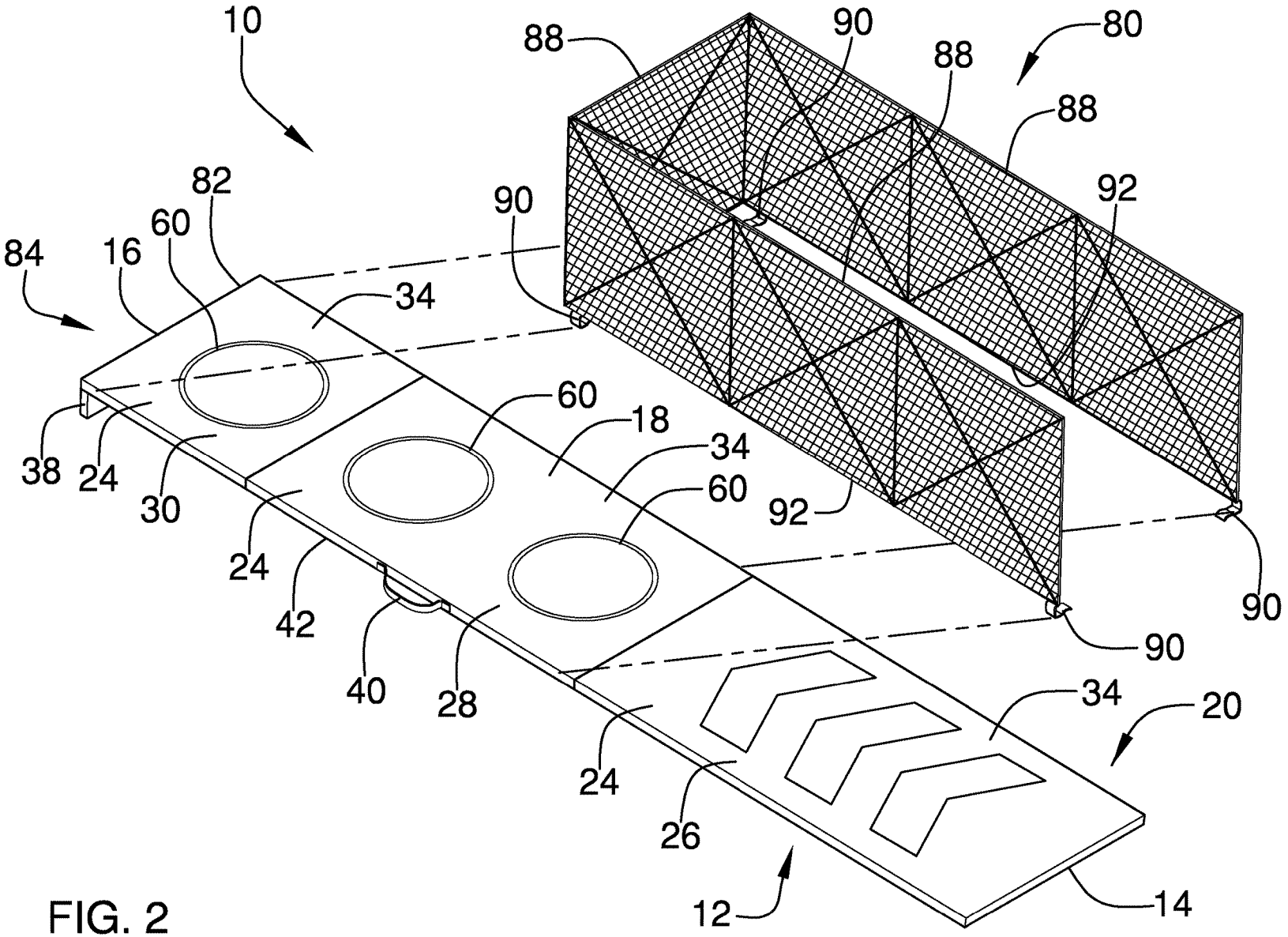
FIG. 2 is an exploded view of an embodiment of the disclosure.

With reference now to the drawings, and in particular to FIGS. 1 through 8 thereof, a new game system embodying the principles and concepts of an embodiment of the disclosure and generally designated by the reference numeral 10 will be described.

As best illustrated in FIGS. 1 through 8, the game system 10 generally comprises a platform 12 with a front end 14 and a rear end 16. The platform 12 has a playing surface 18 extending between said front end 14 and said rear end 16 and which faces upwardly when the platform 12 is positioned in a use configuration 20. The platform 12 is shaped such that the playing surface 18 is configured to be inclined with respect to a ground surface 22 when the platform 12 is positioned on the ground surface 22 in the use configuration 20.

The platform 12 comprises a plurality of panels 24, a support leg 38, and a handle 40. The plurality of panels 24 is pivotally interconnected such that the platform 12 is postionable in a folded configuration 32 wherein the plurality of panels 24 form a stack. The plurality of panels 24 includes a front panel 26, a middle panel 28, and a rear panel 30. The middle panel 28 is pivotally coupled to and extends between the front and rear panels 26, 30. Each panel 24 of the plurality of panels 24 has a playing side 34 and a reverse side 36. The reverse sides 36 of each of the front panel 26 and the rear panel 30 face the reverse side 36 of the middle panel 28 when the platform 12 is positioned in the folded configuration 32.

The support leg 38 is coupled to the rear panel 30 adjacent to the rear end 16 of the platform 12 and is pivotable alternately toward and away from the reverse side 36 of the rear panel 30. The support leg 38 extends away from the reverse side 36 of the rear panel 30 when the platform 12 is positioned in the use configuration 20. The handle 40 is coupled to an outer edge 42 of the middle panel 28 for carrying the platform 12 when the platform 12 is positioned in the folded configuration 32.

A plurality of containers 44 is positionable on the playing surface 18 of the platform 12 in a playing configuration 46 when the platform 12 is positioned in the use configuration 20. The playing configuration 46 comprises the plurality of containers 44 being spaced along a line extending from the rear end 16 of the platform 12 to the front end 14 of the platform 12. In the playing configuration 46, a rearmost container 46 of the plurality of containers 44 is positioned adjacent to the rear end 16 of the platform 12 and a frontmost container 48 of the plurality of containers 44 is spaced rearwardly from the front end 14 of the platform 12.

Figure 3:
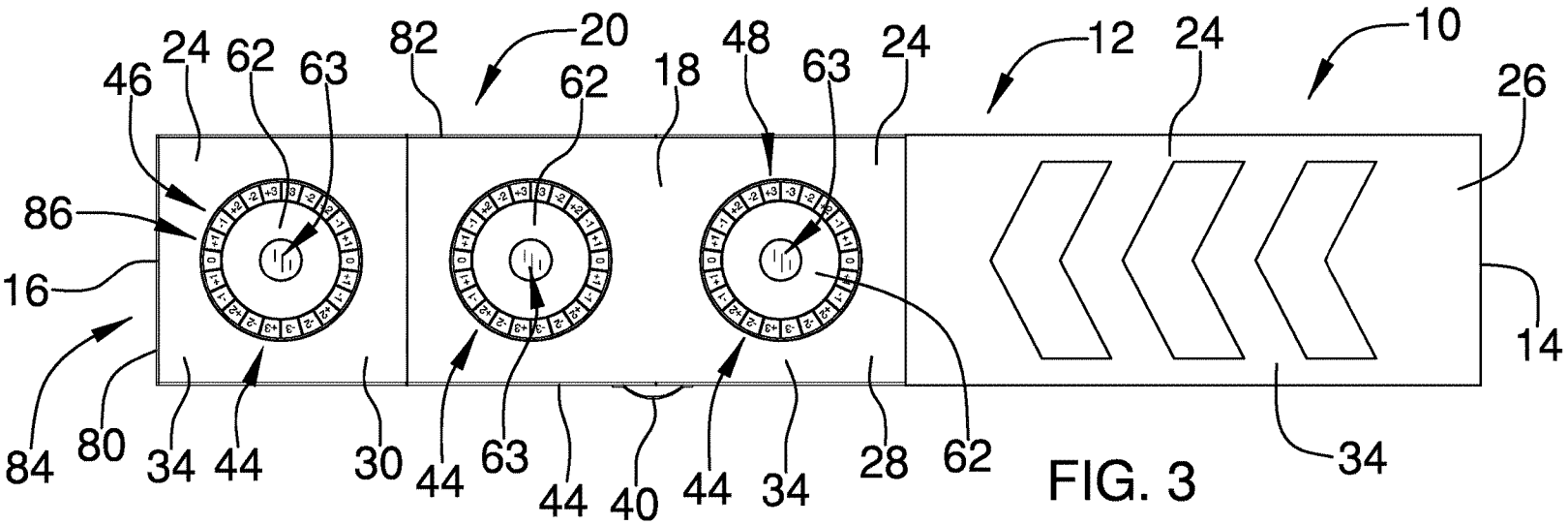
FIG. 3 is a top view of an embodiment of the disclosure.
Figure 4:
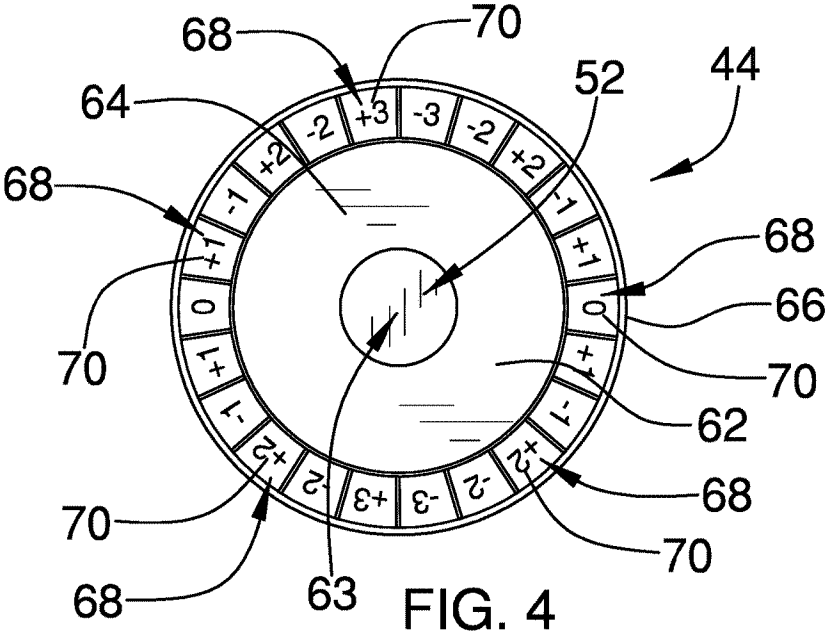
FIG. 4 is a top view of a container of an embodiment of the disclosure.
Figure 5:
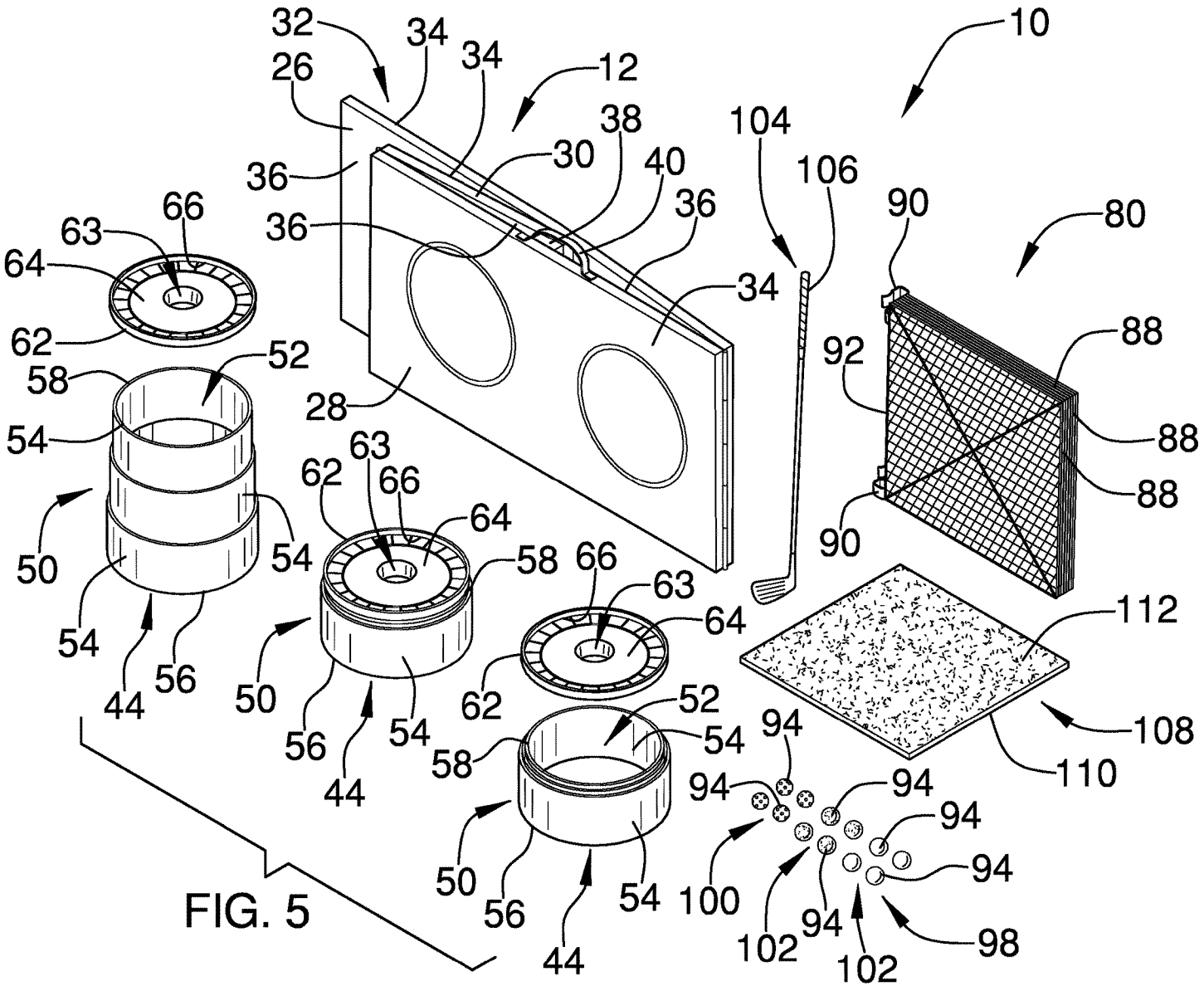
FIG. 5 is a kit view of an embodiment of the disclosure.
Figure 6:
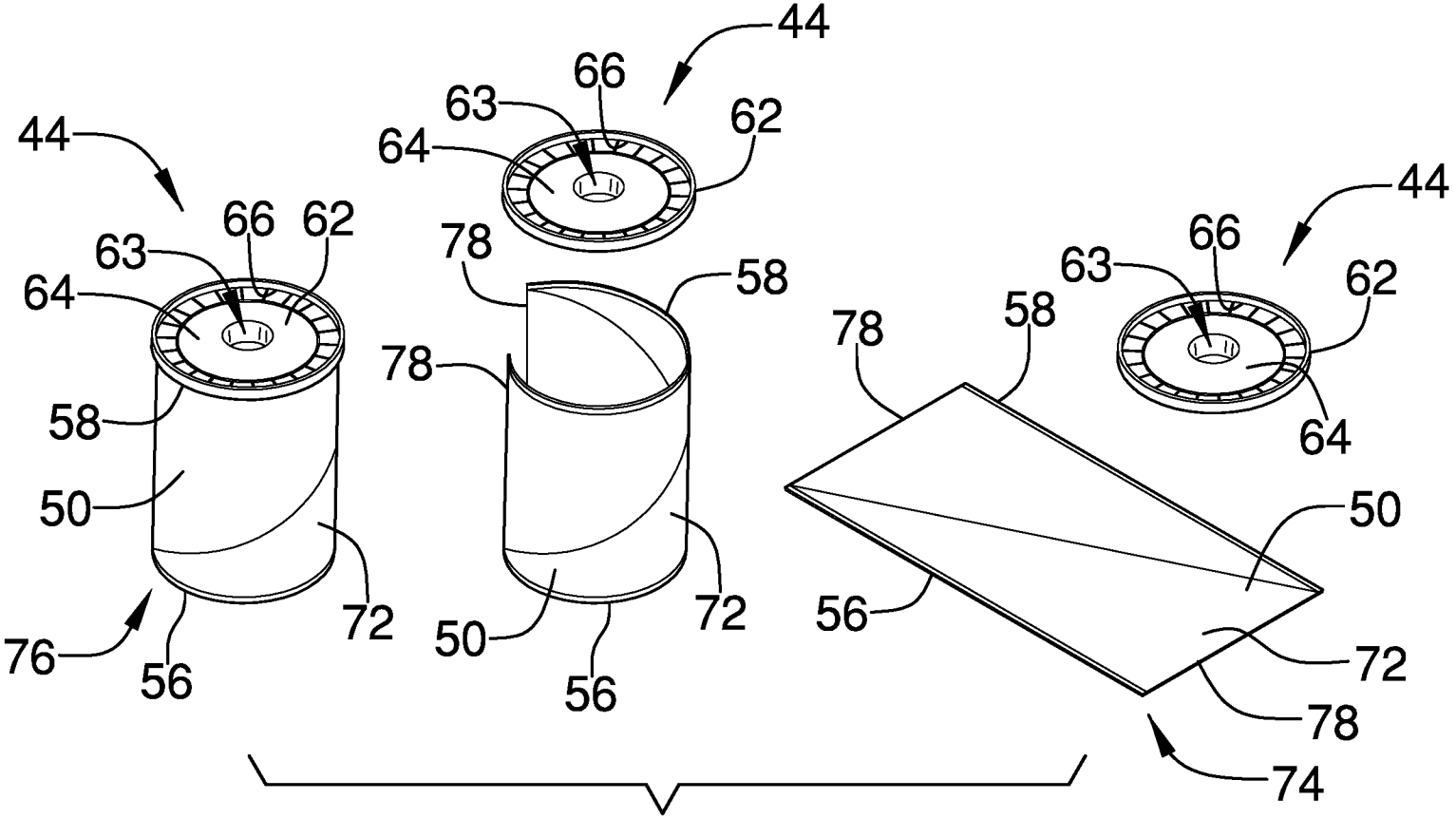
FIG. 6 is a kit view of an alternative embodiment of the disclosure.
Figure 7:
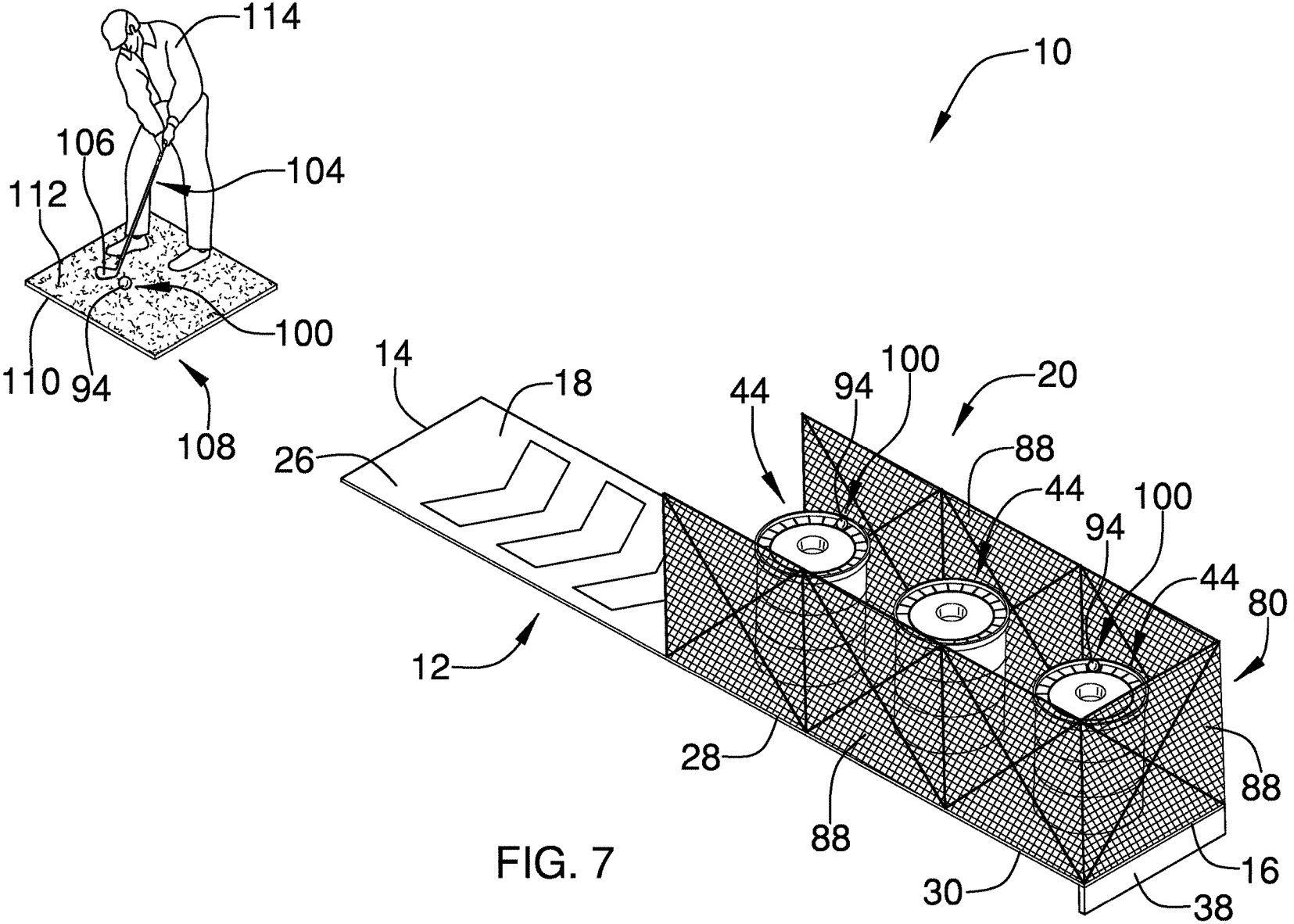
FIG. 7 is an in-use view of an embodiment of the disclosure.
Figure 8:
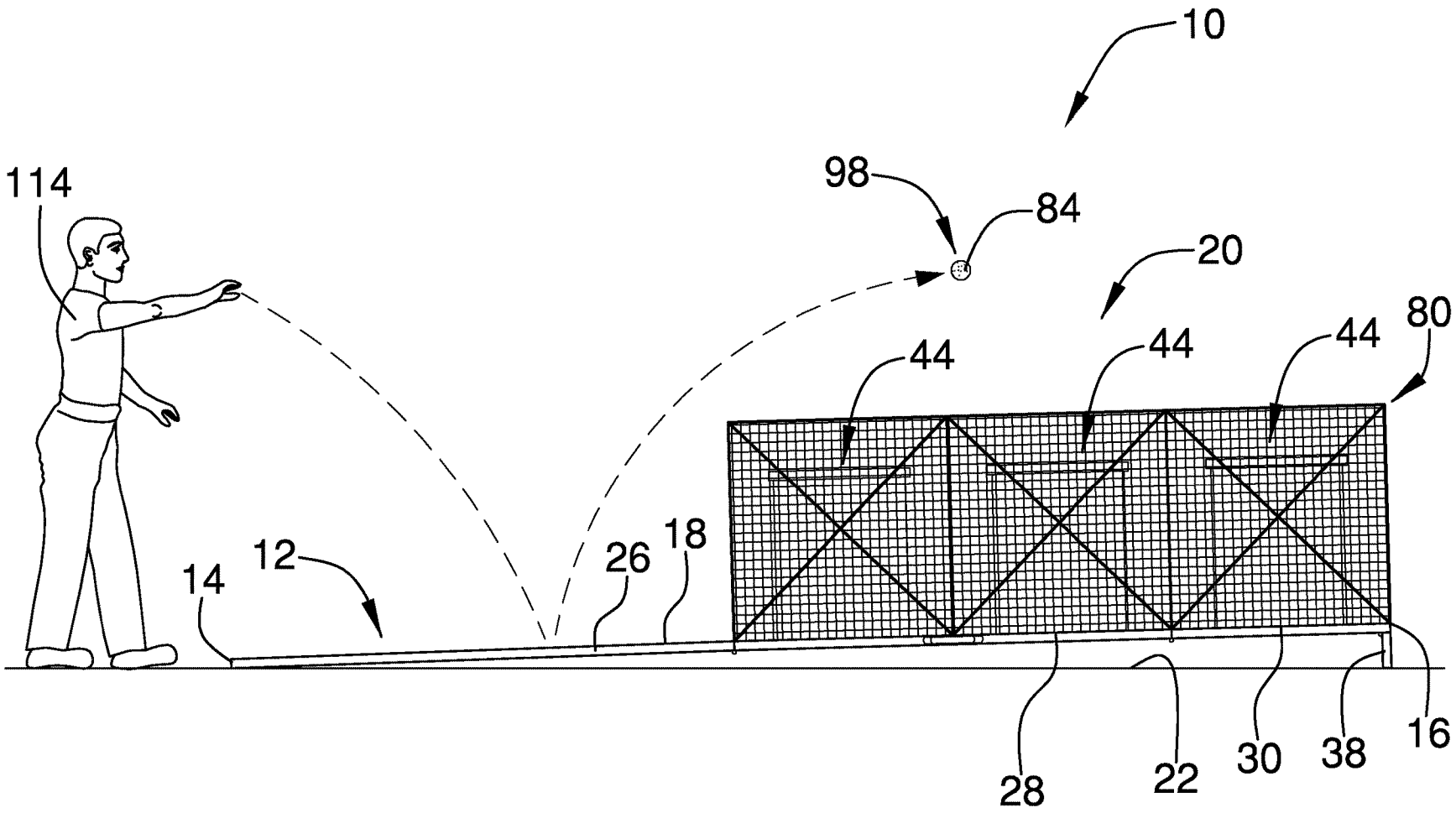
FIG. 8 is an in-use view of an embodiment of the disclosure.

Each container 44 comprises a perimeter wall 50, a top wall 62, a plurality of scoring receptacles 68, and a plurality of scoring indicia 70. The perimeter wall 50 is positionable on the playing surface 18 and bounds an interior space 52. The perimeter wall 50 comprises a plurality of telescopically coupled tubes 54 such that the perimeter wall 50 is collapsible. The platform 12 has a plurality of grooves 60 extending into the playing surface 18, each of which is shaped for receiving a bottom edge 56 of the perimeter wall 50 of an associated container 44 of the plurality of containers 44. The top wall 62 is coupled to a top edge 58 of the perimeter wall 50 and has a hole 63 extending through the top wall 62 to the interior space 52. The top wall 62 is removable from the perimeter wall 50. The plurality of scoring receptacles 68 is coupled to an upper surface 64 of the top wall 62 and is circumferentially arranged along a perimeter edge 66 of the top wall 62. Each scoring indicia 70 of the plurality of scoring indicia 70 is positioned in an associated one of the scoring receptacles 68 and indicates a score value of the associated scoring receptacle 68. The scoring indicia 70 associated with each scoring receptacle 68 is depicted in FIGS. 3 and 4, but different score values from those shown may be used and different symbols, colors, graphical images, alphanumeric characters, and the like may be used to indicate the various score values.

In other embodiments, the perimeter wall 50 of each container 44 of the plurality of containers 44 is formed of a bendable panel 72 that is positionable in a planar configuration 74 for storage and bended from the planar configuration 74 into a tubular configuration 76 to form the perimeter wall 50. Opposing edges 78 of the bendable panel 72 are secured together through a connector such as a latch, a magnetic fastener, a hook-and-loop fastener, or the like. In some embodiments, the bendable panel 72 is retained in the tubular configuration 76 by one or both of the top wall 62 and the platform 12.

A barrier 80 is mountable to a periphery 82 of the playing surface 18 of the platform 12. The barrier 80 extends around a rear portion 84 of the platform 12 and bounds a volume 86 when mounted to the periphery 82 such that the plurality of containers 44 is positioned in the volume 86 when the plurality of containers 44 is positioned in the playing configuration 46. The barrier 80 comprises a plurality of wall sections 88 and a plurality of clips 90. The wall sections 88 are pivotally interconnected such that the barrier 80 is foldable in an accordion fashion into a collapsed configuration 92. Each clip 90 of the plurality of clips 90 is attached to a lower edge 94 of an associated one of the plurality of wall sections 88 and is engageable with an associated panel 24 of the plurality of panels 24 of the platform 12.

A plurality of projectiles 94 is provided, each of which has a size such that each projectile 94 of the plurality of projectiles 94 is alternately receivable into each container 44 of the plurality of containers 44 through the hole 63 of the top wall 62 thereof and is alternately receivable into each scoring receptacle 68 of the plurality of scoring receptacles 68 of each container 44 of the plurality of containers 44. Each projectile 94 has a spherical shape.

The plurality of projectiles 94 includes different sets of projectiles 94 with different mechanical properties. A first set 98 of projectiles 94 of the plurality of projectiles 94 comprises a resiliently compressible material such that each one of the first set 98 of projectiles 94 is configured to rebound off of the front panel 26 of the platform 12 when thrown by a player 114 positioned forwardly of the platform 12 and attain a height above the platform 12 sufficient to land in one of the plurality of containers 44 or in one of the plurality of scoring receptacles 68 of one of the plurality of containers 44. A second set 100 of projectiles 94 of the plurality of projectiles 94 comprises a rigid material such that each one of the second set 100 of projectiles 94 is configured to transfer more kinetic energy to an object when rebounding off the object than one of the first set 98 of projectiles 94. The second set 100 of projectiles 94 is useful for variations of gameplay wherein it is desirable for a launched projectile 94 to retain less kinetic energy after impacting an object, as detailed more below. The second set 100 of projectiles 94 also has a plurality of openings extending therethrough to allow air to pass through each one of the second set 100 of projectiles 94 when launched.

The first set 98 of projectiles 94 includes a pair of subsets 102 of projectiles 94 having differentiable indicia from each other such as different colors, symbols, alphanumeric characters, or the like to indicate which one of a pair of players 114 is using each subset 102 of the pair of subsets 102 of projectiles 94 during a game. The second set 100 of projectiles 94 may also include such a pair of subsets 102 of projectiles 94.

A club 104 is provided which is engageable with a selected projectile 94 of the plurality of projectiles 94 to launch the selected projectile 94 toward the containers 44. The club 104 comprises a golf club 106. The golf club 106 may be a chipper, a wedge, or the like. A chipping mat 108 is positionable to support the selected projectile 94 thereon. The chipping mat 108 comprises a base 110 and a plurality of bristles 112, and each bristle 112 of the plurality of bristles 112 extends upwardly away from the base 110. The selected projectile 94 is positionable on a portion of the plurality of bristles 112.

The game system 10 is used to play a game in which at least one player 114 attempts to score points by launching at least some of the plurality of projectiles 94 into one or more of the plurality of containers 44 or into one or more of the plurality of scoring receptacles 68 of the plurality of containers 44. To set up the game, the platform 12 is positioned in the use configuration 20 and the plurality of containers 44 is positioned in the playing configuration 46. The barrier 80 is mounted to the periphery 82 of the playing surface 18 of the platform 12.

In a first version of the game, a pair of teams comprising one or more players 114 each participate in one or more rounds of play. In each round of play, the pair of teams take turns in alternating fashion to launch one of the first subset 102 of projectiles 94 of the plurality of projectiles 94 toward the plurality of containers 44 in an attempt to earn points.

For each turn, one of the players 114 of the team taking the turn defines a launching player 114. The launching player 114 faces the front end 14 of the platform 12 and throws one of the plurality of projectiles 94 toward the front panel 26 of the platform 12 such that the launched projectile 94 rebounds off the front panel 26. Points are added to the launching player's 114 team's total score if the launched projectile 94 lands in one of the plurality of containers 44. In an embodiment of the game system 10 with three containers 44, two points are added to the launching player's 114 team's total score if the launched projectile 94 lands in the frontmost container 48, four points are added to the launching player's 114 team's total score if the launched projectile 94 lands in the rearmost container 46, and three points are added to the launching player's 114 team's total score if the launched projectile 94 lands in the container 44 positioned between the frontmost and rearmost containers 44.

The round of play continues until the teams have launched all of the plurality of projectiles 94 used for the game. Before starting another round of play, all of the plurality of projectiles 94 are retrieved. The team which reaches a total score of 21 points is the winner of the game.

In a second version of the game, the pair of teams participate in one or more rounds of play. In each round of play, one of the pair of teams takes a turn consecutively launching all of the second subset 102 of projectiles 94 of the plurality of projectiles 94 in an attempt to earn points, then the other one of the pair of teams takes a turn consecutively launching all of the second subset 102 of projectiles 94 of the plurality of projectiles 94 in an attempt to earn points.

For each turn, one of the players 114 of the team taking the turn defines a launching player 114. The launching player 114 positions one of the projectiles 94 of the second set 100 or projectiles 94 on one of the chipping mat 108, the ground surface 22, a tee, or the like which is spaced forwardly with respect to the platform 12. Then the launching player 114 swings the club 104 at the one projectile 94 to urge the one projectile 94 toward the plurality of containers 44. The projectiles 94 of the second subset 102 of projectiles 94 are not intended to rebound off of the front panel 26 in the second version of the game. The second subset 102 of projectiles 94 are therefore more desirable for use in the second version of the game, because the projectiles 94 of the second subset 102 of projectiles 94 are less likely to rebound significantly away from an impacted one of the plurality of scoring receptacles 68 than the projectiles 94 of the first subset 102 of projectiles 94.

If the launched projectile 94 impacts one of the plurality of containers 44 without landing in any of the plurality of containers 44 or in one of the plurality of scoring receptacles 68 of the plurality of containers 44, one point is added to a total score of the launching player's 114 team. If the launched projectile 94 lands in one of the plurality of scoring receptacles 68 of the plurality of containers 44, the score value indicated by the score indicia of the scoring receptacle 68 in which the launched projectile 94 lands is added to the total score of the launching player's 114 team. If the score indicia of the scoring receptacle 68 in which the launched projectile 94 lands is a negative value, the total score of the launching player's 114 team decreases.

Points are added to the launching player's 114 team's total score if the launched projectile 94 lands in one of the plurality of containers 44. In an embodiment of the game system 10 with three containers 44, three points are added to the launching player's 114 team's total score if the launched projectile 94 lands in the frontmost container 48, five points are added to the launching player's 114 team's total score if the launched projectile 94 lands in the rearmost container 46, and four points are added to the launching player's 114 team's total score if the launched projectile 94 lands in the container 44 positioned between the frontmost and rearmost containers 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A game system comprising:

a platform having a front end and a rear end, the platform having a playing surface extending between said front end and said rear end which faces upwardly when the platform is positioned in a use configuration;

a plurality of containers being positionable on the playing surface of the platform in a playing configuration when the platform is positioned in the use configuration, each container comprising:

a perimeter wall being positionable on the playing surface, the perimeter wall bounding an interior space; and a top wall being coupled to a top edge of the perimeter wall, the top wall having a hole extending through the wall to the interior space; and a plurality of projectiles, each projectile of the plurality of projectiles having a size such that each projectile of the plurality of projectiles is alternately receivable into each container of the plurality of containers through the hole of the top wall thereof.

2. The system of claim 1, wherein the platform is shaped such that the playing surface is configured to be inclined with respect to a ground surface when the platform is positioned on the ground surface in the use configuration.

3. The system of claim 1, wherein the platform comprises a plurality of panels being pivotally interconnected such that the platform is postionable in a folded configuration wherein the plurality of panels form a stack, the plurality of panels including a front panel, a middle panel, and a rear panel, the middle panel being pivotally coupled to and extending between the front and rear panels, each panel of the plurality of panels having a playing side and a reverse side, the reverse side of the front panel facing the reverse side of the middle panel when the platform is positioned in the folded configuration, the reverse side of the rear panel facing the reverse side of the middle panel when the platform is positioned in the folded configuration.

4. The system of claim 3, wherein the platform further comprises a support leg being coupled to the rear panel adjacent to the rear end of the platform, the support leg being pivotable alternately toward and away from the reverse side of the rear panel, the support leg extending away from the reverse side of the rear panel when the platform is positioned in the use configuration.

5. The system of claim 3, wherein the platform further comprises a handle being coupled to an outer edge of the middle panel for carrying the platform when the platform is positioned in the folded configuration.

6. The system of claim 1, wherein the perimeter wall of each container of the plurality of containers comprises a plurality of telescopically coupled tubes such that the perimeter wall is collapsible.

7. The system of claim 1, wherein the top wall of each container of the plurality of containers is removable from the perimeter wall of an associated one of the plurality of containers.

8. The system of claim 1, wherein the playing configuration comprises the plurality of containers being spaced along a line extending from the rear end of the platform to the front end of the platform, a rearmost container of the plurality of containers being positioned adjacent to the rear end of the platform and a frontmost container of the plurality of containers being spaced rearwardly from the front end of the platform when the plurality of containers is positioned in the playing configuration.

9. The system of claim 1, wherein:

each container of the plurality of containers further comprises a plurality of scoring receptacles being coupled to an upper surface of the top wall of an associated container of the plurality of containers; and each projectile of the plurality of projectiles is alternately receivable into each scoring receptacle of the plurality of scoring receptacles of each container of the plurality of containers.

10. The system of claim 9, wherein the plurality of scoring receptacles is circumferentially arranged along a perimeter edge of the top wall of the associated container.

11. The system of claim 9, wherein each container of the plurality of containers further comprises a plurality of scoring indicia, each scoring indicia of the plurality of scoring indicia being positioned in an associated one of the scoring receptacles, each scoring indicia of the plurality of scoring indicia indicating a score value of the associated scoring receptacle.

12. The system of claim 1, wherein the platform has a plurality of grooves extending into the playing surface, each groove of the plurality of grooves being shaped for receiving a bottom edge of the perimeter wall of an associated container of the plurality of containers.

13. The system of claim 1, wherein each projectile having a spherical shape.

14. The system of claim 1, further comprising a barrier being mountable to a periphery of the playing surface of the platform, the barrier extending around a rear portion of the platform and bounding a volume when mounted to the periphery such that the plurality of containers is positioned in the volume when the plurality of containers is positioned in the playing configuration.

15. The system of claim 14, wherein the barrier comprises:

a plurality of wall sections being pivotally interconnected such that the barrier is foldable in an accordion fashion into a collapsed configuration; and a plurality of clips, each clip of the plurality of clips being attached to a lower edge of an associated one of the plurality of wall sections, each clip being engageable with an associated panel of the plurality of panels of the platform.

16. The system of claim 1, further comprising a club being engageable with a selected projectile of the plurality of projectiles to launch the selected projectile toward the containers.

17. The system of claim 16, wherein the club comprises a golf club.

18. The system of claim 16, further comprising a chipping mat being positionable to support the selected projectile thereon, the chipping mat comprising a base and a plurality of bristles, each bristle of the plurality of bristles extending upwardly away from the base, the selected projectile being positionable on a portion of the plurality of bristles.

19. A game system comprising:

a platform having a front end and a rear end, the platform having a playing surface extending between said front end and said rear end which faces upwardly when the platform is positioned in a use configuration, the platform being shaped such that the playing surface is configured to be inclined with respect to a ground surface when the platform is positioned on the ground surface in the use configuration, the platform comprising:

a plurality of panels being pivotally interconnected such that the platform is postionable in a folded configuration wherein the plurality of panels form a stack, the plurality of panels including a front panel, a middle panel, and a rear panel, the middle panel being pivotally coupled to and extending between the front and rear panels, each panel of the plurality of panels having a playing side and a reverse side, the reverse side of the front panel facing the reverse side of the middle panel when the platform is positioned in the folded configuration, the reverse side of the rear panel facing the reverse side of the middle panel when the platform is positioned in the folded configuration;

a support leg, the support leg being coupled to the rear panel adjacent to the rear end of the platform, the support leg being pivotable alternately toward and away from the reverse side of the rear panel, the support leg extending away from the reverse side of the rear panel when the platform is positioned in the use configuration; and a handle being coupled to an outer edge of the middle panel for carrying the platform when the platform is positioned in the folded configuration;

a plurality of containers being positionable on the playing surface of the platform in a playing configuration when the platform is positioned in the use configuration, the playing configuration comprising the plurality of containers being spaced along a line extending from the rear end of the platform to the front end of the platform, a rearmost container of the plurality of containers being positioned adjacent to the rear end of the platform and a frontmost container of the plurality of containers being spaced rearwardly from the front end of the platform when the plurality of containers is positioned in the playing configuration, each container comprising:

a perimeter wall being positionable on the playing surface, the perimeter wall bounding an interior space, the perimeter wall comprising a plurality of telescopically coupled tubes such that the perimeter wall is collapsible;

a top wall being coupled to a top edge of the perimeter wall, the top wall having a hole extending through the wall to the interior space, the top wall being removable from the perimeter wall;

a plurality of scoring receptacles being coupled to an upper surface of the top wall, the plurality of scoring receptacles being circumferentially arranged along a perimeter edge of the top wall; and a plurality of scoring indicia, each scoring indicia of the plurality of scoring indicia being positioned in an associated one of the scoring receptacles, each scoring indicia of the plurality of scoring indicia indicating a score value of the associated scoring receptacle;

wherein the platform has a plurality of grooves extending into the playing surface, each groove of the plurality of grooves being shaped for receiving a bottom edge of the perimeter wall of an associated container of the plurality of containers;

a barrier being mountable to a periphery of the playing surface of the platform, the barrier extending around a rear portion of the platform and bounding a volume when mounted to the periphery such that the plurality of containers is positioned in the volume when the plurality of containers is positioned in the playing configuration, the barrier comprising:

a plurality of wall sections being pivotally interconnected such that the barrier is foldable in an accordion fashion into a collapsed configuration; and a plurality of clips, each clip of the plurality of clips being attached to a lower edge of an associated one of the plurality of wall sections, each clip being engageable with an associated panel of the plurality of panels of the platform;

a plurality of projectiles, each projectile of the plurality of projectiles having a size such that each projectile of the plurality of projectiles is alternately receivable into each container of the plurality of containers through the hole of the top wall thereof, each projectile of the plurality of projectiles being alternately receivable into each scoring receptacle of the plurality of scoring receptacles of each container of the plurality of containers, each projectile having a spherical shape;

a club being engageable with a selected projectile of the plurality of projectiles to launch the selected projectile toward the containers, the club having a shape of a golf club; and a chipping mat being positionable to support the selected projectile thereon, the chipping mat comprising a base and a plurality of bristles, each bristle of the plurality of bristles extending upwardly away from the base, the selected projectile being positionable on a portion of the plurality of bristles.

* * * * *